US012503796B2

(12) United States Patent
Uchibori et al.

(10) Patent No.: US 12,503,796 B2
(45) Date of Patent: Dec. 23, 2025

(54) FLAME-RETARDANT FABRIC AND WORK CLOTHING

(71) Applicant: KANEKA CORPORATION, Osaka (JP)

(72) Inventors: Keita Uchibori, Hyogo (JP); Wataru Mio, Hyogo (JP)

(73) Assignee: KANEKA CORPORATION, Osaka (JP)

( * ) Notice: Subject to any disclaimer, the term of this patent is extended or adjusted under 35 U.S.C. 154(b) by 0 days.

(21) Appl. No.: 18/928,882

(22) Filed: Oct. 28, 2024

(65) Prior Publication Data

US 2025/0051980 A1 Feb. 13, 2025

Related U.S. Application Data

(63) Continuation of application No. PCT/JP2023/022309, filed on Jun. 15, 2023.

(30) Foreign Application Priority Data

Jun. 28, 2022 (JP) ..... 2022-103561

(51) Int. Cl.
*D03D 15/513* (2021.01)
*D02G 3/44* (2006.01)

(52) U.S. Cl.
CPC ..... *D03D 15/513* (2021.01); *D02G 3/443* (2013.01); *D10B 2201/01* (2013.01); *D10B 2321/101* (2013.01); *D10B 2501/04* (2013.01)

(58) Field of Classification Search
None
See application file for complete search history.

(56) References Cited

U.S. PATENT DOCUMENTS

| | | | | |
|---|---|---|---|---|
| 7,365,032 | B1 | 4/2008 | Adachi et al. | |
| 2015/0191854 | A1* | 7/2015 | Tanaka | C08F 214/18 524/406 |
| 2016/0201236 | A1 | 7/2016 | Matsumoto et al. | |
| 2017/0175302 | A1 | 6/2017 | Habicht et al. | |
| 2017/0295875 | A1 | 10/2017 | Ohzeki et al. | |
| 2020/0308735 | A1 | 10/2020 | Adams et al. | |
| 2021/0164133 | A1 | 6/2021 | Adams et al. | |
| 2024/0102211 | A1 | 3/2024 | Adams et al. | |
| 2024/0384446 | A1* | 11/2024 | Mio | D03D 15/513 |

FOREIGN PATENT DOCUMENTS

| | | | |
|---|---|---|---|
| EP | 1247885 | A1 | 10/2002 |
| EP | 3037574 | A1 | 6/2016 |
| EP | 3243940 | A1 | 11/2017 |
| JP | 2007-270410 | A | 10/2007 |
| JP | 2017-525867 | A | 9/2017 |
| JP | 2022-520887 | A | 4/2022 |
| WO | 2001/32968 | A1 | 5/2001 |
| WO | 2015/025948 | A1 | 2/2015 |
| WO | 2016/033593 | A1 | 3/2016 |
| WO | 2016/111116 | A1 | 7/2016 |
| WO | 2020/198668 | A1 | 10/2020 |

OTHER PUBLICATIONS

International Search Report issued in International Application No. PCT/JP2023/022309 issued Aug. 22, 2023 (2 pages).

* cited by examiner

*Primary Examiner* — Arti Singh-Pandey
(74) *Attorney, Agent, or Firm* — Osha Bergman Watanabe & Burton LLP

(57) ABSTRACT

One or more embodiments of the present invention relate to a flame-retardant fabric containing a modacrylic fiber in an amount of 30 to 60 mass %, a cellulose fiber in an amount of 20 to 50 mass %, and an aramid fiber in an amount of 10 to 20 mass %. The flame-retardant fabric includes a compound containing stannate and zinc in an amount of 1.4 to 5.0 mass % with respect to a total mass of the flame-retardant fabric. The flame-retardant fabric with improved flame retardancy by suppressing the decrease in tear strength of the fabric after combustion and a work clothing including the flame-retardant fabric are provided.

20 Claims, No Drawings

FLAME-RETARDANT FABRIC AND WORK CLOTHING

TECHNICAL FIELD

One or more embodiments of the present invention relate to a flame-retardant fabric that exhibits high flame retardancy as measured by a flammability test and a work clothing including the flame-retardant fabric.

BACKGROUND

Modacrylic fibers are combined with other fibers, such as cellulose fibers, and are generally and especially used suitably in work clothing. For example, Patent Document 1 describes a flame-retardant fabric including modacrylic fibers containing antimony compounds and cellulose fibers containing phosphorous compounds as a fabric for work clothing. Further, Patent Document 2 describes that modacrylic fibers and cellulose fibers are combined with aramid fibers which are high-strength fibers.

Patent Documents

Patent Document 1: WO2015/025948
Patent Document 2: JP 2017-525867 A

However, when modacrylic fibers containing antimony compounds and aramid fibers are used together in a fabric, the tear strength of the fabric after combustion may become low, and the flame retardancy of the fabric may become poor.

SUMMARY

To address the above, one or more embodiments of the present invention provide a flame-retardant fabric and a work clothing with improved flame retardancy by suppressing a decrease in the tear strength of the fabric after combustion.

One or more embodiments of the present invention relate to a flame-retardant fabric including a modacrylic fiber in an amount of 30 to 60 mass %, a cellulose fiber in an amount of 20 to 50 mass %, and an aramid fiber in an amount of 10 to 20 mass %, wherein the flame-retardant fabric includes a compound containing stannate and zinc in an amount of 1.4 to 5.0 mass % with respect to a total mass of the flame-retardant fabric.

One or more embodiments of the present invention relate to a work clothing including the flame-retardant fabric.

One or more embodiments of the present invention can provide a flame-retardant fabric with improved flame retardancy by suppressing a decrease in tear strength of the fabric after combustion and a work clothing including the flame-retardant fabric.

DETAILED DESCRIPTION

The inventors of one or more embodiments of the present invention have conducted in-depth studies to address a decrease in the tear strength of a fabric including aramid fibers and modacrylic fibers containing antimony compounds after combustion, which lead to longer char length and poor flame retardancy of the fabric. As a result, the inventors found that when using a compound containing stannate and zinc as a flame retardant and incorporating a certain amount of the compound containing stannate and zinc in a fabric containing modacrylic fibers, cellulose fibers, and aramid fibers, the tear strength of the fabric after combustion can be increased so the char length of the fabric can be shortened. In particular, by using modacrylic fibers containing the compound containing stannate and zinc in combination with cellulose fibers and aramid fibers, the tear strength of the fabric after combustion tends to increase easily and the char length of the fabric after combustion tends to shorten easily. When modacrylic fibers containing an antimony compound are used in a fabric, it is presumed that aramid fibers contained in the fabric are damaged by an antimony gas from the modacrylic fibers during combustion, and the tear strength of the fabric after combustion is reduced. On the other hand, when the compound containing stannate and zinc is used in a fabric, it is presumed that aramid fibers contained in the fabric are not damaged, so the tear strength of the fabric after combustion is not reduced, and the char length of the fabric after combustion becomes shorter. However, the present invention is not bound by such speculations.

Although the reason is unclear, this effect is surprisingly unique to using the compound containing stannate and zinc, such as zinc stannate compounds, as flame retardants. In a fabric containing modacrylic fibers, aramid fibers, and cellulose fibers, even if a compound containing stannate, but not zinc and a compound containing zinc, but not stannate are used in combination as flame retardants, the effect of improving the flame retardancy of the fabric cannot be obtained.

The flame-retardant fabric according to one or more embodiments of the present invention contains substantially no antimony compound. In this specification, the wording "containing substantially no antimony compound" means that an antimony compound serving as a flame retardant is not added to a fiber or a fabric on purpose, and that the content of the antimony compound in the fiber or the fabric is about 0 mass %.

In one or more embodiments of the present invention, a char length of the fabric measured by a flammability test based on ASTM D6413 correlates with the tear strength of the fabric after combustion. In one or more embodiments of the present invention, the char length of the fabric measured by a flammability test based on ASTM D6413 is 75 mm or less. In the following, unless otherwise specified, the char length refers to the char length measured by a flammability test based on ASTM D6413.

In this specification, when a numerical range is shown using "to", that includes the values at both ends (i.e., the upper limit and the lower limit). For example, a numerical range "A to B" is a range that includes A and B, which are the values at the two ends of the range. Moreover, any number within the range and any numerical range within the range are specifically disclosed. Also, when a plurality of numerical ranges is described in this specification, numerical ranges obtained by using the upper limits and the lower limits of the different numerical ranges in combination as appropriate are included.

Compound Containing Stannate and Zinc

In one or more embodiments of the present invention, the flame-retardant fabric contains a compound containing stannate and zinc in an amount of 1.4 to 5.0 mass %. If the content of the compound containing stannate and zinc is less than 1.4 mass %, the tear strength of the fabric after combustion may be reduced, so the char length of the fabric after combustion becomes longer and the flame retardancy of the fabric becomes poor. On the other hand, if the content of the compound containing stannate and zinc is more than 5.0 mass %, static electricity may be easily generated during a carding process, which impairs spinnability, resulting in poor productivity and processability of fibers and the fabric as well as high cost. Further, in flammability tests, the afterglow time of the flame-retardant fabric is increased and the flame retardancy of the flame-retardant fabric is inferior. The flame-retardant fabric may contain the compound containing stannate and zinc in an amount of 1.6 mass % or more, 1.8 mass % or more, 2.0 mass % or more, or 2.5 mass % or more, from the viewpoint of increasing the tear strength of the flame-retardant fabric and shortening the char length of the flame-retardant fabric after combustion. The flame-retardant fabric may contain the compound containing stannate and zinc in an amount of 4.9 mass % or less, 4.8 mass % or less, 4.7 mass % or less, 4.6 mass % or less, or 4.5 mass % or less, from the viewpoint of productivity, processability, and cost. The compound containing stannate and zinc may be attached to the surface of the flame-retardant fabric. However, from the viewpoint of washing durability, the compound containing stannate and zinc may be contained inside the fibers constituting the flame-retardant fabric. The compound containing stannate and zinc may be contained inside the modacrylic fiber, from the viewpoint of enhancing the flame retardancy effect of the compound containing stannate and zinc. In one or more embodiments of the present invention, the content of the compound containing stannate and zinc in the flame-retardant fabric may be measured by fluorescence X-ray analysis, specifically as described in the Example.

The compound containing stannate and zinc is not particularly limited, and from the viewpoint of general purpose, for example, any zinc stannate compound may be used. The zinc stannate compound may be zinc stannate ($ZnSnO_3$) or zinc hydroxystannate ($ZnSn(OH)_6$). Among them, for example, zinc hydroxystannate may be preferable, from the viewpoint of further improving flame retardancy of the fiber, the flame-retardant fabric, and the work clothing.

An average particle size D50 of the compound containing stannate and zinc is not particularly limited, for example, from the viewpoint of spinnability and fiber strength, it may be 3 μm or less, 2.5 μm or less, or 2 μm or less. There is no particular limitation on the lower limit of the average particle size D50 of the compound containing stannate and zinc, for example, from the viewpoint of the handleability, it may be 0.1 μm or more, 0.5 μm or more, 0.6 μm or more, or 0.7 μm or more. In one or more embodiments of the present invention, the average particle size D50 of a compound is based on volume standard distribution and may be measured by a laser diffraction/scattering method if the compound is in a powder form or may be measured by a laser diffraction/scattering method or a dynamic light scattering method in the case of using a dispersion (liquid dispersion) obtained by dispersing the compound in water or an organic solvent.

Modacrylic Fibers

The modacrylic fibers are not particularly limited as long as made of a modacrylic polymer, and any fiber containing the modacrylic polymer may be used as appropriate. The modacrylic fibers may contain the compound containing stannate and zinc in addition to the modacrylic polymer, and the compound containing stannate and zinc may be contained inside the modacrylic fiber. By incorporating the compound containing stannate and zinc inside the modacrylic fiber, washing durability is improved, and the compound containing stannate and zinc, which serves as a flame retardant, provides high flame retardancy effects even after repeated washing.

The modacrylic fibers may contain the compound containing stannate and zinc in an amount of 2.4 mass % or more, 2.5 mass % or more, 2.8 mass % or more, 3.0 mass % or more, 3.5 mass % or more, or 3.7 mass % or more, from the viewpoint of improving the flame retardancy of the fabric. The modacrylic fibers may contain the compound containing stannate and zinc in an amount of 10.4 mass % or less, 10.2 mass % or less, 10.0 mass % or less, 9.8 mass % or less, 9.6 mass % or less, 9.4 mass % or less, or 9.2 mass % or less, from the viewpoint of productivity, processability, and fiber physical properties of the modacrylic fibers. In one or more embodiments of the present invention, the content of the compound containing stannate and zinc in the modacrylic fibers may be measured by fluorescence X-ray analysis, specifically as described in Examples.

The modacrylic fibers may contain the modacrylic polymer in an amount of 89.6 to 97.6 mass %, and the compound containing stannate and zinc in an amount of 2.4 to 10.4 mass %, contain the modacrylic polymer in an amount of 89.8 to 97.5 mass %, and the compound containing stannate and zinc in an amount of 2.5 to 10.2 mass %, contain the modacrylic polymer in an amount of 90.0 to 97.2 mass %, and the compound containing stannate and zinc in an amount of 2.8 to 10.0 mass %, contain the modacrylic polymer in an amount of 90.2 to 97.0 mass %, and the compound containing stannate and zinc in an amount of 3.0 to 9.8 mass %, contain the modacrylic polymer in an amount of 90.4 to 96.5 mass %, and the compound containing stannate and zinc in an amount of 3.5 to 9.6 mass %, contain the modacrylic polymer in an amount of 90.6 to 96.3 mass %, and the compound containing stannate and zinc in an amount of 3.7 to 9.4 mass %, or contain the modacrylic polymer in an amount of 90.8 to 96.3 mass %, and the compound containing stannate and zinc in an amount of 3.7 to 9.2 mass %, from the viewpoint of improving the flame retardancy of the fabric. Alternatively, the modacrylic fibers may contain the compound containing stannate and zinc in an amount of 2.5 parts by mass or more, 3.0 parts by mass or more, 3.2 parts by mass or more, 3.8 parts by mass or more, or 4.0 parts by mass or more, with respect to 100 parts by mass of the modacrylic polymer, from the viewpoint of improving the flame retardancy of the fabric. The modacrylic fibers may contain the compound containing stannate and zinc in an amount of 11.0 parts by mass or less, 10.5 parts by mass or less, 10.0 parts by mass or less, 9.8 parts by mass or less, 9.6 parts by mass or less, 9.4 parts by mass or less, or 9.2 parts by mass or less, with respect to 100 parts by mass of the modacrylic polymer, from the viewpoint of productivity, processability and fiber physical properties of the modacrylic fibers.

The modacrylic polymer may contain acrylonitrile in an amount of 40 to 70 mass %, and other components in an amount of 30 to 60 mass %. If the content of acrylonitrile in the modacrylic polymer is within 40 to 70 mass %, the modacrylic fiber may have favorable heat resistance and flame retardancy.

The other components are not particularly limited as long as they are copolymerizable with acrylonitrile, and examples thereof include halogen-containing monomers and sulfonic acid group-containing monomers.

Examples of the halogen-containing monomers include halogen-containing vinyl and halogen-containing vinylidene. Examples of the halogen-containing vinyl include vinyl chloride and vinyl bromide. Examples of the halogen-containing vinylidene include vinylidene chloride and vinylidene bromide. The halogen-containing monomers may be used alone or in combination of two or more. The modacrylic polymer may contain the halogen-containing monomers as other components in an amount of 30 to 60 mass %, from the viewpoint of heat resistance and flame retardancy.

Examples of the sulfonic acid group-containing monomers include methacryl sulfonic acid, allyl sulfonic acid, styrene sulfonic acid, and 2-acrylamide-2-methylpropane sulfonic acid, as well as salts thereof. Examples of the salts include sodium salts, potassium salts, and ammonium salts, but there is no particular limitation thereto. The sulfonic acid group-containing monomers may be used alone, or two or more of them may be used in combination. The sulfonic acid group-containing monomers may be used as necessary, for example, to improve dyeability. When the modacrylic polymer contains 3 mass % or less of the sulfonic acid group-containing monomers, the production stability in the spinning process will be excellent. The modacrylic polymer may contain the sulfonic acid group-containing monomers in an amount of 0.5 to 3 mass %.

The modacrylic polymer may contain acrylonitrile in an amount of 40 to 70 mass %, the halogen-containing monomers in an amount of 30 to 57 mass %, and the sulfonic acid group-containing monomers in an amount of 0 to 3 mass %, or contain acrylonitrile in an amount of 45 to 65 mass %, the halogen-containing monomers in an amount of 35 to 52 mass %, and the sulfonic acid group-containing monomers in an amount of 0 to 3 mass %. The halogen-containing monomers may be vinyl chloride and/or vinylidene chloride, or vinylidene chloride, from the viewpoint of handleability and flame retardancy.

The modacrylic polymer may contain acrylonitrile in an amount of 40 to 69.5 mass %, the halogen-containing monomers in an amount of 30 to 57 mass %, and the sulfonic acid group-containing monomers in an amount of 0.5 to 3 mass %, or contain acrylonitrile in an amount of 45 to 64.5 mass %, the halogen-containing monomers in an amount of 35 to 52 mass %, and the sulfonic acid group-containing monomers in an amount of 0.5 to 3 mass %, from the viewpoint of dyeability. The halogen-containing monomers may be vinyl chloride and/or vinylidene chloride, or vinylidene chloride, from the viewpoint of handleability and flame retardancy.

The modacrylic polymer may be obtained by a known polymerization method such as bulk polymerization, suspension polymerization, emulsion polymerization, or solution polymerization. Of these, suspension polymerization, emulsion polymerization, or solution polymerization may be preferable from industrial standpoint.

The modacrylic fibers may contain various additives such as a flame retardant auxiliary, a matting agent, a crystal nucleating agent, a dispersant, a lubricant, a stabilizer, a fluorescent agent, an antioxidant, an antistatic agent, and a pigment as needed within a range that does not inhibit the effects of one or more embodiments of the present invention. The modacrylic fibers may contain other additives other than the compound containing stannate and zinc in an amount of 5 mass % or less, 3 mass % or less, or 1 mass % or less, within a range that does not inhibit the effects of one or more embodiments of the present invention. Alternatively, the modacrylic fibers may contain other additives other than the compound containing stannate and zinc in an amount of 5 parts by mass or less, 3 parts by mass or less, or 1 part by mass or less, with respect to 100 parts by mass of the modacrylic polymer, within a range that does not inhibit the effects of one or more embodiments of the present invention.

The single fiber fineness of the modacrylic fibers is not particularly limited, and it may be 1 to 20 dtex, or 1.5 to 15 dtex, from the viewpoint of spinnability, processability, and the texture and the strength of a woven fabric and/or knitted fabric made of the modacrylic fibers. Also, the fiber length of the modacrylic fibers is not particularly limited, and it may be 38 to 127 mm, or 38 to 76 mm from the viewpoint of spinnability and processability. In this specification, the single fiber fineness of the fibers may be measured according to JIS L 1015:2021.

The strength of the modacrylic fibers is not particularly limited, and it may be 1.0 to 4.0 cN/dtex, or 1.5 to 3.0 cN/dtex, from the viewpoint of spinnability and processability. Also, the elongation of the modacrylic fibers is not particularly limited, and it may be 20 to 35%, or 20 to 25%, from the viewpoint of spinnability and processability. In this specification, the strength and elongation of the fibers may be measured according to JIS L 1015:2021.

The modacrylic fibers including the compound containing stannate and zinc inside the fiber may be manufactured through wet spinning of a spinning solution in the same manner as in the manufacture of common modacrylic fibers, except that the compound containing stannate and zinc, and optionally other additives are added to a spinning solution in which the modacrylic polymer is dissolved. The spinning solution may contain the compound containing stannate and zinc in an amount of 2.5 to 11.0 parts by mass, 3.0 to 10.5 parts by mass, 3.2 to 10.0 parts by mass, 3.8 to 9.8 parts by mass, or 4.0 to 9.6 parts by mass, with respect to 100 parts by mass of the modacrylic polymer, from the viewpoint of flame retardancy, productivity, processability, and fiber physical properties of the modacrylic fiber, for example. The spinning solution may contain other additives other than the compound containing stannate and zinc in an amount of 5 parts by mass or less, 3 parts by mass or less, or 1 part by mass or less, with respect to 100 parts by mass of the modacrylic polymer, within a range that does not inhibit the effects of one or more embodiments of the present invention.

The modacrylic fibers may be spun-dyeing fibers. Dyeing of a fabric that contains the spun-dyeing modacrylic fibers is not necessary, so the environmental impact and costs of manufacturing the fabric can be reduced. The spun-dyeing modacrylic fibers may be obtained by spinning the spinning solution in which the compound containing stannate and zinc and colorants are added. The colorants include, for example, organic pigments, inorganic pigments, and dyes.

Cellulose Fibers

Cellulose fibers are fibers derived from cellulose and may include natural cellulose fibers, semi-synthesis cellulose fibers, and regenerated cellulose fibers. Examples of natural cellulose fibers include cotton fibers, hemp fibers (such as linen fibers, ramie fibers, jute fibers, kenaf fibers, hemp fibers, Manila hemp fibers, sisal hemp fibers, and New Zealand hemp fibers), kapok fibers, banana fibers, and palm fibers. Examples of semi-synthesis cellulose fibers include acetate fibers and triacetate fibers. Examples of regenerated cellulose fibers include rayon fibers, cupra fibers, and lyocell fibers. These cellulose fibers may be used alone, or two or more of them may be used in combination.

The cellulose fibers may include flame retardants, for example. The cellulose fibers may contain the compound containing stannate and zinc as flame retardant, but may contain a phosphorus-based flame retardant.

The cellulose fibers may include one or more selected from the group consisting of natural cellulose fibers and the regenerated cellulose fibers, one or more selected from the group consisting of lyocell fibers, flame-retardant lyocell fibers, rayon fibers, and flame-retardant rayon fibers, or lyocell fibers.

The flame-retardant lyocell fibers may contain the phosphorus-based flame retardant. Examples of the phosphorus-based flame retardant include phosphoric ester-based compounds, halogen-containing phosphoric ester-based compounds, condensed phosphoric ester-based compounds, polyphosphate-based compounds, and polyphosphoric ester-based compounds, and there is no particular limitation thereto. From the viewpoint of improving flame retardancy, the flame-retardant lyocell fibers may include the phosphorus derived from the phosphorus-based flame retardant in an amount of 0.5 mass % or more, or 0.8 mass % or more, for example, and there is no particular limitation thereto. Meanwhile, from the viewpoint of fiber strength, the flame-retardant lyocell fibers may include the phosphorus derived from the phosphorus-based flame retardant in an amount of 10 mass % or less, for example.

The flame-retardant rayon fibers may contain the phosphorus-based flame retardant. Examples of the phosphorus-based flame retardant include phosphoric ester-based compounds, halogen-containing phosphoric ester-based compounds, condensed phosphoric ester-based compounds, polyphosphate-based compounds, and polyphosphoric ester-based compounds, and there is no particular limitation thereto. From the viewpoint of improving flame retardancy, the flame-retardant rayon fibers may include the phosphorus derived from the phosphorus-based flame retardant in an amount of 0.5 mass % or more, or 0.8 mass % or more, for example, and there is no particular limitation thereto. On the other hand, for example, from the viewpoint of fiber strength, the flame-retardant rayon fibers may include the phosphorus derived from the phosphorus-based flame retardant in an amount of 10 mass % or less. In this specification, the content of the phosphorus in the fibers may be measured by fluorescence X-ray analysis.

The single fiber fineness of the cellulose fibers is not particularly limited, and it may be 1 to 20 dtex, or 1.5 to 15 dtex, from the viewpoint of strength. Also, the fiber length of the cellulose fibers is not particularly limited, and it may be 38 to 127 mm, or 38 to 76 mm from the viewpoint of strength.

Aramid Fibers

Aramid fibers may be para-aramid fibers or meta-aramid fibers. The single fiber fineness of the aramid fibers is not particularly limited, and it may be 1 to 20 dtex, or 1.5 to 15 dtex, from the viewpoint of strength of the aramid fibers. Also, the fiber length of the aramid fibers is not particularly limited, and it may be 38 to 127 mm, or 38 to 76 mm from the viewpoint of strength of the aramid fibers.

Flame-Retardant Fabric

In one or more embodiments of the present invention, the flame-retardant fabric may contain the modacrylic fibers in an amount of 30 to 60 mass %, the cellulose fibers in an amount of 20 to 50 mass %, and the aramid fibers in an amount of 10 to 20 mass %, contain the modacrylic fibers in an amount of 35 to 55 mass %, the cellulose fibers in an amount of 25 to 50 mass %, and the aramid fibers in an amount of 10 to 18 mass %, or contain the modacrylic fibers in an amount of 38 to 53 mass %, the cellulose fibers in an amount of 30 to 50 mass %, and the aramid fibers in an amount of 10 to 18 mass %. If the content of the modacrylic fibers is small, the flame retardancy of the flame-retardant fabric may be inferior. On the other hand, if the content of the modacrylic fibers including the compound containing stannate and zinc is high, static electricity may be easily generated during a carding process, resulting in poor spinnability, so the productivity and processability of the flame-retardant fabric are inferior. If the content of the cellulose fibers is small, it may lead to poor texture of the flame-retardant fabric. If the content of the aramid fibers is small, the tear strength of the flame-retardant fabric may decrease, leading to poor flame retardancy of the flame-retardant fabric. The flame-retardant fabric may contain the compound containing stannate and zinc in an amount of 1.4 to 5.0 mass %, 1.6 to 4.9 mass %, 1.8 to 4.8 mass %, 2.0 to 4.7 mass %, or 2.5 to 4.5 mass %.

In one or more embodiments of the present invention, the flame-retardant fabric may contain the modacrylic fibers in an amount of 30 to 60 mass %, one or more of regenerated cellulose fibers selected from the group consisting of lyocell fibers, flame-retardant lyocell fibers, rayon fibers, and flame-retardant rayon fibers in an amount of 20 to 50 mass %, and the para-aramid fibers in an amount of 10 to 20 mass %, contain the modacrylic fibers in an amount of 35 to 55 mass %, one or more of regenerated cellulose fibers selected from the group consisting of lyocell fibers, flame-retardant lyocell fibers, rayon fibers, and flame-retardant rayon fibers in an amount of 25 to 50 mass %, and the para-aramid fibers in an amount of 10 to 18 mass %, or contain the modacrylic fibers in an amount of 38 to 53 mass %, one or more of regenerated cellulose fibers selected from the group consisting of lyocell fibers, flame-retardant lyocell fibers, rayon fibers, and flame-retardant rayon fibers in an amount of 30 to 50 mass %, and the para-aramid fibers in an amount of 10 to 18 mass % from the viewpoint of further improving flame retardancy, texture, cost and durability. In one or more embodiments of the present invention, the modacrylic fibers may contain the compound containing stannate and zinc in an amount of 2.4 to 10.4 mass %, 2.5 to 10.2 mass %, 2.8 to 10.0 mass %, 3.0 to 10.0 mass %, 3.5 to 9.8 mass %, 3.5 to 9.6 mass %, 3.5 to 9.4 mass %, or 3.5 to 9.2 mass %.

In one or more embodiments of the present invention, the flame-retardant fabric may contain the modacrylic fibers in an amount of 30 to 60 mass %, the lyocell fibers in an amount of 20 to 50 mass %, and the para-aramid fibers in an amount of 10 to 20 mass %, contain the modacrylic fibers in an amount of 35 to 55 mass %, the lyocell fibers in an amount of 25 to 50 mass %, and the para-aramid fibers in an amount of 10 to 18 mass %, or contain the modacrylic fibers in an amount of 38 to 53 mass %, the lyocell fibers in an amount of 30 to 50 mass %, and the para-aramid fibers in an amount of 10 to 18 mass % from the viewpoint of further improving flame retardancy, texture, cost and durability. In one or more embodiments of the present invention, the modacrylic fibers may contain the compound containing stannate and zinc in an amount of 2.4 to 10.4 mass %, 2.5 to 10.2 mass %, 2.8 to 10.0 mass %, 3.0 to 10.0 mass %, 3.5 to 9.8 mass %, 3.5 to 9.6 mass %, 3.5 to 9.4 mass %, or 3.5 to 9.2 mass %.

In one or more embodiments of the present invention, the flame-retardant fabric may contain other fibers in addition to the modacrylic fibers, the cellulose fibers, and the aramid fibers as long as the purposes and effects of one or more embodiments of the present invention are not inhibited. Examples of the other fibers include conductive fibers, heat-resistant fibers, and high-strength high-elasticity fibers. Examples of the conductive fibers include metallic fibers, metal-plated fibers, copper compound-coated fibers, and conductive material-containing fibers. Examples of the heat-resistant fibers include polyoxadiazole fibers, polyimide fibers, and polyamideimide fibers. Examples of the high-strength high-elasticity fibers include nylon fibers, polyester fibers, and polyarylate fibers. The flame-retardant fabric may contain the other fibers in an amount of 10 mass % or less, 8 mass % or less, or 1 mass % or less, with respect to the total mass of the fabric.

The single fiber fineness of the other fibers is not particularly limited, and it may be 1 to 20 dtex, or 1.5 to 15 dtex, from the viewpoint of strength of the other fibers. Also, the fiber length of the other fibers is not particularly limited, and it may be 38 to 127 mm, or 38 to 76 mm from the viewpoint of strength of the other fibers.

There is no particular limitation on the form of the flame-retardant fabric, and examples thereof include a woven fabric and a knitted fabric. There is no particular limitation on the weave of the woven fabric. Three foundation weaves such as a plain weave, a twill weave, and a sateen weave may be applied, and a patterned woven fabric obtained by using a special loom such as a dobby loom or a Jacquard loom may be used. Also, there is no particular limitation on the knitting of the knitted fabric, and any circular knitting, flat knitting, and warp knitting may be applied. The flame-retardant fabric may be a woven fabric, or a twill woven fabric, from the viewpoint of excellent durability.

Although there is no particular limitation on the basis weight of the flame-retardant fabric, from the viewpoint of texture and flame retardancy, it may be 200 to 400 g/m$^2$, 220 to 380 g/m$^2$, or 250 to 350 g/m$^2$.

In one or more embodiments of the present invention, the flame-retardant fabric has excellent flame retardancy, and the char length of the flame-retardant fabric measured by a flammability test based on ASTM D6413 may be 75 mm or less, 73 mm or less, or 71 mm or less. When the char length of the flame-retardant fabric differs between the wrap and the weft directions, the maximum value thereof may be 75 mm or less, 73 mm or less, or 71 mm or less.

In one or more embodiments of the present invention, the flame-retardant fabric has excellent flame retardancy, and the afterglow time of the flame-retardant fabric measured by a flammability test based on ASTM D6413 may be 10.0 seconds or less, 9.5 seconds or less, or 9.0 seconds or less. When the afterglow time of the flame-retardant fabric differs between the wrap and the weft directions, the maximum value thereof may be 10.0 seconds or less, 9.5 seconds or less, or 9.0 seconds or less.

Work Clothing

In one or more embodiments of the present invention, the flame-retardant fabric can be favorably used as a fabric for a work clothing that requires flame retardancy. In one or more embodiments of the present invention, the work clothing may be produced using the flame-retardant fabric through a known sewing method. In one or more embodiments of the present invention, the flame-retardant fabric has excellent flame retardancy, and thus the work clothing also has excellent flame retardancy. Also, since the flame-retardant fabric has excellent texture even after being repeatedly washed, the work clothing maintains excellent flame retardancy and texture even after being repeatedly washed. In one or more embodiments of the present invention, the work clothing can be used in any field of work in which the flame retardancy is required. For example, the work clothing can be used as protective clothing (fire-fighting clothing) to be worn by a firefighter, the protective clothing to be worn in workplaces in the fields of petroleum, petrochemistry, coal mining, electric power, welding, and the like in which accidents such as a fire may happen, and the work clothing to be worn in workplaces in the fields of metalwork and the like in which accidents such as a dust explosion are likely to happen, but there is no particular limitation thereto.

EXAMPLES

One or more embodiments of the present invention will be described more specifically with reference to examples. It is to be noted, however, that the present invention is not limited to the following examples.

The measurement and evaluation methods used in examples and comparative examples are as follows.

Static Electricity During Carding

In the production process of a fabric, the amount of static electricity generated as fibers passed through a carding machine was measured with an electrostatic meter ("FMX-003" manufactured by SIMCO JAPAN), and the spinnability was evaluated according to the following criteria.

Good: The amount of static electricity generated as fibers passed through a carding machine was −0.5 to +0.5 kV Poor: The amount of static electricity generated as fibers passed through a carding machine was less than −0.5 kV or more than +0.5 kV Flame Retardancy The flame retardancy of the fabric was measured by a flammability test based on ASTM D6413-99. The char length of the fabric is defined as the distance from the fabric edge, which is directly exposed to the flame under test conditions of ASTM D6413-99 to the furthest point of visible fabric damage after a specified tearing force has been applied. The char length of the fabric was measured according to ASTM D6413-99 "Standard Test Method for Flame Resistance of Textiles (Vertical Method)". The char length is an index for flame retardancy, and the shorter the char length, the better the flame retardancy. Further, the char length of the fabric is correlated with the tear strength of the fabric after the flammability test, and the higher the tear strength after the flammability test, the shorter the char length. Further, the afterglow time of the fabric was measured by a flammability test based on ASTM D6413-99.

Flame Retardant Content

The content of a flame retardant (the compound containing stannate and zinc) in modacrylic fibers or a flame-retardant fabric was measured through fluorescent X-ray analysis using a fluorescent X-ray device ("SEA2210A" manufactured by SII Nano Technology Inc.). The fluorescent X-ray intensity of stannate was measured using a standard sample having a known stannate content, and a calibration curve was created in advance. Then, the fluorescent X-ray intensity of stannate in the modacrylic fibers or the flame-retardant fabric was measured, and the stannate content in the modacrylic fibers or the flame-retardant fabric was calculated by checking the measured fluorescent X-ray intensity against the calibration curve. Then, the content of the compound containing stannate and zinc in the modacrylic fibers or the flame-retardant fabric was calculated based on the stannate content.

Production Example 1

A modacrylic polymer containing 51 mass % of acrylonitrile, 48 mass % of vinylidene chloride, and 1 mass % of sodium p-styrenesulfonate was dissolved in dimethyl sulfoxide such that the modacrylic polymer concentration was 30 mass %. A spinning solution was produced by adding, to the obtained polymer solution, 4 parts by mass of antimony trioxide ($Sb_2O_3$, manufactured by Nihon Seiko Co., Ltd., product name "PATOX-M") with respect to 100 parts by mass of the modacrylic polymer. A dispersion liquid was prepared in advance by adding antimony trioxide to dimethyl sulfoxide at a concentration of 30 mass % and uniformly dispersing antimony trioxide, and this dispersion liquid was used as an antimony trioxide dispersion liquid. In the antimony trioxide dispersion liquid, the average particle size D50 of antimony trioxide measured through the laser diffraction/scattering method was 1.0 μm. The obtained spinning solution was extruded into a 50 mass % aqueous solution of dimethyl sulfoxide through a 300-hole nozzle with a nozzle hole diameter of 0.08 mm and was coagulated, followed by washing the obtained coagulated filaments with water and drying at 120° C. The dried filaments were drawn until the lengths were tripled, followed by heat treatment at 145° C. for 5 minutes. Thus, modacrylic fibers were obtained. The obtained modacrylic fibers of Production Example 1 had a single fiber fineness of 1.7 dtex and a cut length of 51 mm.

Production Example 2

Modacrylic fibers were produced in the same manner as in Production Example 1, except that the added amount of antimony trioxide was changed to 8 parts by mass with respect to 100 parts by mass of the modacrylic polymer. The obtained modacrylic fibers of Production Example 2 had a single fiber fineness of 1.6 dtex and a cut length of 51 mm.

Production Example 3

Modacrylic fibers were produced in the same manner as in Production Example 1, except that the added amount of antimony trioxide was changed to 9 parts by mass with respect to 100 parts by mass of the modacrylic polymer. The obtained modacrylic fibers of Production Example 3 had a single fiber fineness of 1.7 dtex and a cut length of 51 mm.

Production Example 4

Modacrylic fibers were produced in the same manner as in Production Example 1, except that zinc hydroxystannate ($ZnSn(OH)_6$, manufactured by SCL Italia. Spa, product name "Zinflam (registered trademark) ZHS") was used instead of antimony trioxide and the added amount of zinc hydroxystannate was 2 parts by mass with respect to 100 parts by mass of the modacrylic polymer. In the zinc hydroxystannate dispersion liquid, the average particle size D50 of zinc hydroxystannate measured through the laser diffraction/scattering method was 1.2 μm. The obtained modacrylic fibers of Production Example 4 had a single fiber fineness of 1.7 dtex and a cut length of 51 mm.

Production Example 5

Modacrylic fibers were produced in the same manner as in Production Example 4, except that the added amount of zinc hydroxystannate was changed to 4 parts by mass with respect to 100 parts by mass of the modacrylic polymer. The obtained modacrylic fibers of Production Example 5 had a single fiber fineness of 1.6 dtex and a cut length of 51 mm.

Production Example 6

Modacrylic fibers were produced in the same manner as in Production Example 4, except that the added amount of zinc hydroxystannate was changed to 6 parts by mass with respect to 100 parts by mass of the modacrylic polymer. The obtained modacrylic fibers of Production Example 6 had a single fiber fineness of 2.0 dtex and a cut length of 51 mm.

Production Example 7

Modacrylic fibers were produced in the same manner as in Production Example 4, except that the added amount of zinc hydroxystannate was changed to 7 parts by mass with respect to 100 parts by mass of the modacrylic polymer. The obtained modacrylic fibers of Production Example 7 had a single fiber fineness of 1.7 dtex and a cut length of 51 mm.

Production Example 8

Modacrylic fibers were produced in the same manner as in Production Example 4, except that the added amount of zinc hydroxystannate was changed to 8 parts by mass with respect to 100 parts by mass of the modacrylic polymer. The obtained modacrylic fibers of Production Example 8 had a single fiber fineness of 1.7 dtex and a cut length of 51 mm.

Production Example 9

Modacrylic fibers were produced in the same manner as in Production Example 4, except that the added amount of zinc hydroxystannate was changed to 9 parts by mass with respect to 100 parts by mass of the modacrylic polymer. The obtained modacrylic fibers of Production Example 9 had a single fiber fineness of 1.8 dtex and a cut length of 51 mm.

Production Example 10

Modacrylic fibers were produced in the same manner as in Production Example 4, except that the added amount of zinc hydroxystannate was changed to 10 parts by mass with respect to 100 parts by mass of the modacrylic polymer. The obtained modacrylic fibers of Production Example 10 had a single fiber fineness of 1.8 dtex and a cut length of 51 mm.

Production Example 11

Modacrylic fibers were produced in the same manner as in Production Example 1, except that stannic oxide ($SnO_2$, manufactured by Showa Kako Corp.) and zinc borate ($ZnB_6O_{11}\cdot 3.5H_2O$, manufactured by Sakai Chemical Industry Co., Ltd.) were used instead of antimony trioxide and each of the added amounts of stannic oxide and zinc borate was 4 parts by mass, and the total added amount of stannic oxide and zinc borate was 8 parts by mass with respect to 100 parts by mass of the modacrylic polymer. In the stannic oxide dispersion liquid, the average particle size D50 of stannic oxide measured through the laser diffraction/scattering method was 1.7 μm. In the zinc borate dispersion liquid, the average particle size D50 of zinc borate measured through the laser diffraction/scattering method was 1.5 μm. The obtained modacrylic fibers of Production Example 11 had a single fiber fineness of 1.9 dtex and a cut length of 51 mm.

The kinds and the contents of flame retardant in the modacrylic fibers of Production Examples 1 to 11 are shown in Table 1 below.

TABLE 1

| | Contents of flame retardant(mass %) | | |
|---|---|---|---|
| Production Example | Antimony trioxide | Zinc hydroxystannate | Total of stannic oxide and zinc borate |
| 1 | 3.85 | 0 | 0 |
| 2 | 7.41 | 0 | 0 |

TABLE 1-continued

| Production Example | Contents of flame retardant(mass %) Antimony trioxide | Zinc hydroxystannate | Total of stannic oxide and zinc borate |
|---|---|---|---|
| 3 | 8.26 | 0 | 0 |
| 4 | 0 | 1.96 | 0 |
| 5 | 0 | 3.85 | 0 |
| 6 | 0 | 5.66 | 0 |
| 7 | 0 | 6.54 | 0 |
| 8 | 0 | 7.41 | 0 |
| 9 | 0 | 8.26 | 0 |
| 10 | 0 | 9.09 | 0 |
| 11 | 0 | 0 | 7.41 |
| 12 | 0 | 13.04 | 0 |

Examples 1 to 8, Comparative Examples 1 to 8

The modacrylic fibers of Production Examples (Pro. Ex.) 1 to 11, lyocell fibers ("TENCEL (registered trademark)", manufactured by Lenzing AG, single fiber fineness: 1.3 dtex, fiber length: 51 mm) and para-aramid fibers (Taparan (registered trademark), manufactured by Yantai Tayho Advanced Materials Co., Ltd., single fiber fineness: 1.7 dtex, fiber length: 51 mm) were blended together at ratios shown in Table 2 below, the resulting fiber blend was opened with a carding machine ("sample roller card SC-500", manufactured by DIAWAKIKO Co., LTD.) and produced into slivers using a small drawing machine ("TSM-DFS", manufactured by INTEC Co., LTD.). Then, the obtained slivers were produced into roving yarns by a high-speed roving frame ("FL200", manufactured by TOYOTA INDUSTRIES CORPORATION), and the obtained roving yarns were produced into 12.5/1 to 13.5/1 count ring spun yarns by a high-speed spinning frame ("UA37", manufactured by Howa Machinery, Ltd.). A woven fabric with 2/1 twill weave was produced using the obtained ring spun yarns. The numbers of picks and basis weight are shown in Table 2 below.

The flame retardancy of each of the fabrics obtained in Examples 1 to 8 and Comparative Examples 1 to 8 was measured as described above. Table 2 shows the results. Table 2 also shows the contents of flame retardant in the fabrics.

TABLE 2

| | Pro. Ex. No. of Modacrylic fibers | Blend ratio (mass %) Modacrylic fibers | Lyocell fibers | Para-aramid fibers | Contents of flame retardants (mass %) Antimony trioxide | Zinc hydroxy stannate | Stannic oxide and zinc borate | Basis weight (g/m$^2$) |
|---|---|---|---|---|---|---|---|---|
| Ex. 1 | 5 | 48 | 37 | 15 | 0 | 1.85 | 0 | 244 |
| Ex. 2 | 6 | 48 | 37 | 15 | 0 | 2.72 | 0 | 249 |
| Ex. 3 | 8 | 48 | 37 | 15 | 0 | 3.56 | 0 | 250 |
| Ex. 4 | 10 | 48 | 37 | 15 | 0 | 4.36 | 0 | 240 |
| Ex. 5 | 6 | 40 | 48 | 12 | 0 | 2.26 | 0 | 249 |
| Ex. 6 | 7 | 40 | 48 | 12 | 0 | 2.62 | 0 | 228 |
| Ex. 7 | 8 | 40 | 48 | 12 | 0 | 2.96 | 0 | 250 |
| Ex. 8 | 9 | 40 | 48 | 12 | 0 | 3.3 | 0 | 229 |
| Comp. Ex. 1 | 1 | 48 | 37 | 15 | 1.85 | 0 | 0 | 240 |
| Comp. Ex. 2 | 2 | 48 | 37 | 15 | 3.56 | 0 | 0 | 241 |
| Comp. Ex. 3 | 4 | 48 | 37 | 15 | 0 | 0.94 | 0 | 244 |
| Comp. Ex. 4 | 3 | 40 | 48 | 12 | 3.3 | 0 | 0 | 227 |
| Comp. Ex. 5 | 11 | 40 | 48 | 12 | 0 | 0 | 2.96 | 229 |
| Comp. Ex. 6 | 10 | 20 | 65 | 15 | 0 | 1.82 | 0 | 238 |
| Comp. Ex. 7 | 5 | 70 | 15 | 15 | 0 | 2.69 | 0 | 236 |
| Comp. Ex. 8 | 12 | 48 | 37 | 15 | 0 | 6.26 | 0 | 240 |

| | Numbers of picks (yarn/inch) Warp | Weft | Char length (mm) Warp | Weft | Afterglow time (Sec.) Warp | Weft | Spinnability Static electricity during carding (kV) | Evaluation |
|---|---|---|---|---|---|---|---|---|
| Ex. 1 | 75 | 51 | 63.6 | 37.4 | 8.5 | 8.8 | Not measured | |
| Ex. 2 | 75 | 51 | 63 | 44.6 | 8.6 | 8.9 | Not measured | |
| Ex. 3 | 75 | 51 | 59 | 39 | 8.1 | 9.2 | Not measured | |
| Ex. 4 | 75 | 51 | 52.8 | 38.6 | 8.2 | 8.1 | −0.01 | Good |
| Ex. 5 | 75 | 52 | 61 | 40 | 7.6 | 8.1 | Not measured | |
| Ex. 6 | 75 | 52 | 65 | 39 | 7.3 | 7.2 | Not measured | |
| Ex. 7 | 75 | 52 | 63 | 51 | 6.7 | 7 | Not measured | |
| Ex. 8 | 75 | 52 | 71 | 49 | 7 | 7 | 0 | good |
| Comp. Ex. 1 | 75 | 51 | 97.8 | 90.8 | 4.9 | 5.4 | Not measured | |
| Comp. Ex. 2 | 75 | 51 | 94 | 76.2 | 4.1 | 4.8 | Not measured | |
| Comp. Ex. 3 | 75 | 51 | 80.8 | 67.4 | 7.2 | 7.5 | Not measured | |
| Comp. Ex. 4 | 75 | 52 | 92 | 54 | 4.6 | 4.2 | −0.01 | Good |
| Comp. Ex. 5 | 75 | 52 | Burn out | | | | Not measured | |
| Comp. Ex. 6 | 75 | 51 | Burn out | | | | −0.01 | Good |
| Comp. Ex. 7 | 75 | 51 | 51.6 | 36.4 | 13.1 | 12.5 | −0.65 to −0.85 | Poor |
| Comp. Ex. 8 | 75 | 51 | 52.1 | 37.9 | 11.1 | 10.8 | −0.53 to −0.75 | Poor |

As shown in Table 2 above, for each of the fabrics in the examples, the maximum value of the char length measured by the flammability test based on ASTM D6413-99 was 75 mm or less and the flame retardancy was very excellent. Further, in Examples 4 and 8, almost no static electricity was generated during the carding process, so the productivity and processability of the fabrics were good. In addition, in Examples 1 to 3, in which the fiber's blend ratio was the same as in Example 4 and the modacrylic fibers contained less zinc hydroxystannate than the modacrylic fibers in Example 4, it is presumed that almost no static electricity was generated during the carding process and the productivity and processability of the fabrics were good. Also, in Examples 5 to 7, in which the fiber's blend ratio was the same as in Example 8 and the modacrylic fibers contained less zinc hydroxystannate than the modacrylic fibers in Example 8, it is presumed that almost no static electricity was generated during the carding process and the productivity and processability of the fabrics were good. Further, for each of the fabrics in the examples, the afterglow time measured by the flammability test based on ASTM D6413-99 was 10 seconds or less and the flame retardancy was quite excellent.

On the other hand, in Comparative Example 3, which used the modacrylic fibers containing zinc hydroxystannate as a flame retardant, similarly to Examples 1 to 8 meanwhile the content of zinc hydroxystannate was less than 1.4 mass %, the maximum value of the char length measured by the flammability test based on ASTM D6413-99 was more than 75 mm, so the flame retardancy of the fabric was poor.

In Comparative Example 1, where the content of the flame retardant and the blending ratio of the modacrylic fibers, the cellulose fiber, and the aramid fibers were the same as in Example 1, but the antimony trioxide was used as a flame retardant, the char length measured by the flammability test based on ASTM D6413-99 was long and the flame retardancy of the fabric was poor, as compared to Example 1. Similarly, in each of Comparative Examples 2 and 4, in which the content of the flame retardant and the blending ratio of the modacrylic fibers, the cellulose fiber, and the aramid fibers were the same as in each of Examples 3 and 8, but the antimony trioxide used as a flame retardant, the char length measured by the flammability test based on ASTM D6413-99 was long and the flame retardancy of the fabric was poor, as compared to each of Examples 3 and 8.

In Comparative Example 5, which used the modacrylic fibers of Productive Example 11 containing stannic oxide and zinc borate together as flame retardants, when the flame retardancy of the fabric measured by the flammability test based on ASTM D6413-99, the flame could not be extinguished and the flame retardancy was poor.

In Comparative Example 6, where the content of the modacrylic fibers was low, when the flame retardancy of the fabric was measured by the flammability test based on ASTM D6413-99, the flame could not be extinguished and the flame retardancy was poor.

In Comparative Example 7, where the content of the modacrylic fibers containing zinc hydroxystannate in the fabric was high, and in Comparative Example 8, where the content of zinc hydroxystannate in the fabric was high, static electricity generated during the carding process was high and the productivity and processability of the fabrics were poor. Further, In Comparative Example 7, where the content of the modacrylic fibers containing zinc hydroxystannate in the fabric was high, and in Comparative Example 8, where the content of zinc hydroxystannate in the fabric was high, the afterglow time of the fabrics measured by the flammability test based on ASTM D6413-99 was more than 10 seconds, so the flame retardancy of the fabrics was poor.

The present invention is not particularly limited, and may encompass the following embodiments.

[1] A flame-retardant fabric comprising:

a modacrylic fiber in an amount of 30 to 60 mass %, a cellulose fiber in an amount of 20 to 50 mass %, and an aramid fiber in an amount of 10 to 20 mass %, wherein the flame-retardant fabric comprises a compound containing stannate and zinc in an amount of 1.4 to 5.0 mass % with respect to a total mass of the flame-retardant fabric.

[2] The flame-retardant fabric according to [1], wherein a char length of the flame-retardant fabric measured by a flammability test based on ASTM D6413 is 75 mm or less.

[3] The flame-retardant fabric according to [1] or [2], wherein the modacrylic fiber comprises the compound containing stannate and zinc.

[4] The flame-retardant fabric according to [3], wherein the modacrylic fiber comprises the compound containing stannate and zinc in an amount of 2.4 to 10.4 mass %.

[5] The flame-retardant fabric according to any one of [1] to [4], wherein the compound containing stannate and zinc comprises one or more selected from the group consisting of zinc hydroxystannate and zinc stannate.

[6] The flame-retardant fabric according to any one of [1] to [5], wherein the cellulose fiber comprises one or more selected from the group consisting of a natural cellulose fiber and a regenerated cellulose fiber.

[7] The flame-retardant fabric according to any one of [1] to [6], wherein the cellulose fiber comprises one or more selected from the group consisting of a lyocell fiber, a flame-retardant lyocell fiber, a rayon fiber, and a flame-retardant rayon fiber.

[8] The flame-retardant fabric according to any one of [1] to [7], wherein the cellulose fiber comprises a lyocell fiber.

[9] The flame-retardant fabric according to any one of [1] to [8], wherein the aramid fiber is a para-aramid fiber.

[10] The flame-retardant fabric according to any one of [1] to [9], wherein the modacrylic fiber is a spun-dyeing fiber.

[11] The flame-retardant fabric according to any one of [1] to [10], wherein an afterglow time of the flame-retardant fabric measured by a flammability test based on ASTM D6413 is 10 seconds or less.

[12] A work clothing comprising:

the flame-retardant fabric according to any one of [1] to [11].

Although the disclosure has been described with respect to only a limited number of embodiments, those skilled in the art, having benefit of this disclosure, will appreciate that various other embodiments may be devised without departing from the scope of the present disclosure. Accordingly, the scope of the invention should be limited only by the attached claims.

The invention claimed is:

1. A flame-retardant fabric comprising:

a modacrylic fiber in an amount of 30 to 60 mass %, a cellulose fiber in an amount of 20 to 50 mass %, and an aramid fiber in an amount of 10 to 20 mass %, wherein:

the flame-retardant fabric comprises a compound containing stannate and zinc in an amount of 1.6 to 3.56 mass % with respect to a total mass of the flame-retardant fabric, the compound containing stannate and zinc comprises one or more selected from the group consisting of zinc hydroxystannate and zinc stannate, the flame-retardant fabric comprises substantially no antimony compound, and a char length of the flame-retardant fabric measured by a flammability test based on ASTM D6413 is 71 mm or less.

2. The flame-retardant fabric according to claim 1, wherein the modacrylic fiber comprises the compound containing stannate and zinc.

3. The flame-retardant fabric according to claim 2, wherein the modacrylic fiber comprises the compound containing stannate and zinc in an amount of 2.4 to 10.4 mass %.

4. The flame-retardant fabric according to claim 1, wherein the cellulose fiber comprises one or more selected from the group consisting of a natural cellulose fiber and a regenerated cellulose fiber.

5. The flame-retardant fabric according to claim 1, wherein the cellulose fiber comprises one or more selected from the group consisting of a lyocell fiber, a flame-retardant lyocell fiber, a rayon fiber, and a flame-retardant rayon fiber.

6. The flame-retardant fabric according to claim 1, wherein the cellulose fiber comprises a lyocell fiber.

7. The flame-retardant fabric according to claim 1, wherein the aramid fiber is a para-aramid fiber.

8. The flame-retardant fabric according to claim 1, wherein the modacrylic fiber is a spun-dyeing fiber.

9. The flame-retardant fabric according to claim 1, wherein an afterglow time of the flame-retardant fabric measured by a flammability test based on ASTM D6413 is 10 seconds or less.

10. The flame-retardant fabric according to claim 1, wherein the flame-retardant fabric is made of spun yarns, and the spun yarns comprise the modacrylic fiber in an amount of 30 to 60 mass %, the cellulose fiber in an amount of 20 to 50 mass %, and the aramid fiber in an amount of 10 to 20 mass %.

11. The flame-retardant fabric according to claim 1, wherein the flame-retardant fabric is made of spun yarns, and the spun yarns comprise the modacrylic fiber in an amount of 40 to 48 mass %, the cellulose fiber in an amount of 37 to 48 mass %, and the aramid fiber in an amount of 12 to 15 mass %.

12. A work clothing comprising:

the flame-retardant fabric according to claim 1.

13. The work clothing according to claim 12, wherein the modacrylic fiber comprises the compound containing stannate and zinc.

14. The work clothing according to claim 12, wherein the modacrylic fiber comprises the compound containing stannate and zinc in an amount of 2.4 to 10.4 mass %.

15. The work clothing according to claim 12, wherein the compound containing stannate and zinc comprises one or more selected from the group consisting of zinc hydroxystannate and zinc stannate.

16. The work clothing according to claim 12, wherein the flame-retardant fabric is made of spun yarns, and the spun yarns comprise the modacrylic fiber in an amount of 30 to 60 mass %, the cellulose fiber in an amount of 20 to 50 mass %, and the aramid fiber in an amount of 10 to 20 mass %.

17. The work clothing according to claim 12, wherein the flame-retardant fabric is made of spun yarns, and the spun yarns comprise the modacrylic fiber in an amount of 40 to 48 mass %, the cellulose fiber in an amount of 37 to 48 mass %, and the aramid fiber in an amount of 12 to 15 mass %.

18. The flame-retardant fabric according to claim 1, wherein the flame-retardant fabric comprising the compound containing stannate and zinc comprises the modacrylic fiber in an amount of 38 to 53 mass %, the cellulose fiber comprising a lyocell fiber in an amount of 30 to 50 mass %, and the aramid fiber comprising a para-aramid fiber in an amount of 10 to 18 mass %.

19. The flame-retardant fabric according to claim 18, wherein the compound containing stannate and zinc comprises zinc hydroxystannate.

20. A work clothing comprising:

the flame-retardant fabric according to claim 19.

* * * * *